United States Patent [19]

Peytavin

[11] 4,184,534

[45] Jan. 22, 1980

[54] TILTING DEVICE FOR VERTICALLY CAST METAL SECTIONS

[75] Inventor: Pierre Peytavin, Neuilly-sur-Seine, France

[73] Assignee: Creusot-Loire-Vallourec, Paris, France

[21] Appl. No.: 917,284

[22] Filed: Jun. 20, 1978

[30] Foreign Application Priority Data

Jun. 24, 1977 [FR] France ..... 77 19454

[51] Int. Cl.[2] ..... B22D 11/128

[52] U.S. Cl. ..... 164/269; 164/263

[58] Field of Search ..... 164/263, 269, 447, 448

[56] References Cited

U.S. PATENT DOCUMENTS

| | | | |
|---|---|---|---|
| 3,525,383 | 8/1970 | Golde | 164/269 X |
| 3,565,157 | 2/1971 | Peytavin | 164/269 X |

FOREIGN PATENT DOCUMENTS

| | | | |
|---|---|---|---|
| 1496099 | 9/1967 | France | 164/269 |

*Primary Examiner*—Robert D. Baldwin
*Attorney, Agent, or Firm*—Brisebois & Kruger

[57] ABSTRACT

A tilting device for tilting cast metal sections formed by continuous vertical casting. The sections are formed along a casting axis of the installation and are supported by a movable support on the tilting device during their casting. The tilting device is pivoted on a horizontal axis formed by wheels resting on a support. A cable and winch tilt the device to a horizontal position in which the movable support discharges the metal section. Rails to the front and rear of the casting axis and along which the wheels roll permit displacing the tilting device with respect to the casting axis in both the vertical and horizontal position of the tilting device. Cables and winches are used to displace the tilting device. The arrangement permits maintenance and repair of either end of the tilting device during normal operation of adjacent casting lines. The entire tilting device can be rolled away to the front of the casting installation for removal and replacement.

10 Claims, 9 Drawing Figures

TILTING DEVICE FOR VERTICALLY CAST METAL SECTIONS

The present invention relates to a tilting or swinging device for cut-off metal sections formed by a continuous vertical casting process, particularly a continuous rotary vertical casting process.

Tilting devices are, for example, described in U.S. Pat. No. 3,567,157. These devices receive the cast blank which is progressively displaced downwardly by the extraction rollers during casting, cut the blank to make a separated metal section, tilt the metal section, and finally discharge the section, usually toward a cooling area.

A tilting device of this type comprises a cradle whose length corresponds essentially to the length of the cast section that one wants to obtain, and which can be tilted by a rocking or tilting mechanism, around an axis essentially near its center of gravity, between a vertical position in which it receives the blank during manufacture and a horizontal position in which the blank section is discharged. This cradle is provided with means enabling it to hold or support the casting as it descends during casting (when the tilt device is vertical), and enabling it to push the cut-off section to the end of the device, when it is disposed in a horizontal position. Usually, the casting receiving cradle comprises a hollow cylinder open along one of its generatrices and extending over the greatest part of the length of the cradle, the supporting of the casting during its descent in the cylinder, and the horizontal discharge of the cut-off section being accomplished by an abutment of appropriate form, furnished with a rotatable headstock in the case of a rotary continuous casting, the abutment engaging the inside of the cylinder and being displaced along the cylinder by an endless chain extending around two gears placed at opposite ends of the cradle, one of the gears being motor driven.

The tilting mechanism for the cradle usually comprises an hydraulic jack fixed to a gear rack which engages a toothed sector fixed to the cradle.

In industrial continuous casting installations, and especially in rotary continuous casting, it is necessary to provide such a tilting device for each of the casting lines. Considering the dimensions of such tilting devices, actually 10 meters and greater, and the difficulty of providing access for inspection and maintenance personnel, especially because of the circulation of cooling water and scattering of sparks from the operation of the cut-off saw located above the cradle of the tilting device, it is very difficult in practice to carry out the operations of maintenance and repair on the rocking mechanism of the cradle as well as the motor and the abutment located on this cradle. In fact, it is practically not possible to carry out these operations on one of the tilting devices of a series of several when the other casting lines are in operation, and as a result, maintenance or repair operations on any of the tilting devices can be done only during complete shut-down of the whole installation.

The present invention provides a tilting device for which it is possible to carry out the operations of repair and maintenance, especially at the two extremities of the cradle, without having to interrupt operation of the entire continuous casting installation, that is to say during operation of the other casting lines as well as the tilting devices which are associated with them. The tilting device according to the invention can likewise be placed in and removed from the installation under the same operating conditions. In addition, the tilting device according to the present invention comprises, for tilting the cradle, a mechanism which is simpler and thus more reliable in operation than the mechanisms previously used.

The present invention has as an object, as a new industrial product, a tilting device for metal blank sections formed by vertical continuous casting, comprising a cradle whose length corresponds essentially to the length of the blank section, pivoting around an axis situated near its center of gravity under the action of a tilting mechanism, the cradle having a longitudinally moveable support or abutment to retain the blank when the cradle is in the vertical position and to discharge it when the cradle is in the horizontal position, the tilting device being characterized by the fact that the tilting mechanism comprises at least one hauling means, more particularly a winch, mounted on the framework of the casting installation at a location above the upper extremity of the cradle, when in its vertical position, and spaced laterally toward the rear relative to the axis of casting, the hauling means being connected to the cradle by a cable fixed to the cradle near its lower extremity.

The expressions "upper extremity" and "lower extremity" used in this description designate naturally the corresponding extremities of the cradle when it is in a vertical position. The expressions "toward the rear" and "toward the front" of the axis of casting designate positions and movements in opposite directions. "Toward the front" also designates the direction of ejection of the blank section after it has been brought into a horizontal position by tilting of the cradle.

It is understood that by activating the hauling means, a pull is exerted on the cable and thus the cradle is tilted between its vertical position for receiving the blank, and its horizontal position for discharge of the blank.

In a particular embodiment of the invention, a means is provided to lock the cradle in a vertical position on the framework of the casting installation, this locking means being for example a hook connected to the cradle near its lower extremity and engaging behind a projection of the framework. The hook can advantageously be part of a lever having its end fixed to the cable joining the cradle to the hauling means, a pull on the cable pivoting the lever to first release the hook from the corresponding projection of the framework and then cause the tilting of the cradle.

According to the invention, and to assure easy access for maintenance personnel to the two extremities of the cradle, the tilting device is also provided with means enabling it to be displaced, while in a vertical position and in a horizontal position, both toward the rear and toward the front of the axis of casting.

To provide for shifting the cradle toward the rear while in a horizontal position, there is at least one second hauling means, such as a winch, positioned toward the rear of the axis of casting, essentially at the elevation of the tilting axis of the cradle and spaced from the tilting axis by a distance greater than the distance between the tilting axis of the cradle and the lower extremity of the cradle. A third hauling means can likewise be provided at a location spaced in front of the casting axis to assure displacements of the cradle toward the front, in the horizontal position.

The cradle is advantageously supplied at its tilting axis with lateral rail wheels which can roll on rails mounted on a structure fixed to the framework of the casting installation and comprising two horizontal surfaces each joined by a ramp to a depression or recess in which the wheels are positioned during the tilting phase of the tilting device. When the second or the third hauling means is activated, the wheels move out of the recess along the appropriate one of the ramps and roll onto the corresponding horizontal surface. The horizontal surface extending toward the rear advantageously comprises at its extremity a stop defining the maximum horizontal movement of the wheels toward the rear.

The second and third hauling means can be connected to the cradle by cables fastened respectively near the lower extremity of the cradle, and near its upper extremity.

When access to the lower extremity of the cradle is desired, the first hauling means is operated to tilt the cradle to a horizontal position, and then the second hauling means is operated to pull the horizontal cradle toward the rear in a direction opposite to the direction of ejection of the blank. Then a traction is exerted on the cable fixed near the lower extremity of the cradle until this extremity comes over a platform provided in the casting installation which allows access by personnel to the extremity of the cradle which has been brought there. This platform advantageously has rails on which wheels mounted under the cradle near its lower extremity can roll. To remove the tilting device from the installation, the third hauling means is activated to disengage the cradle from the recess, to make it roll on the ramp toward the front and then pull the cradle while in its horizontal position onto the horizontal surface of the structure fixed to the framework, and then onto a platform provided for this purpose in front of the casting axis. To facilitate these displacements the cradle can advantageously be equipped with other wheels to roll on the rails on the structure and on the platform.

To shift the cradle while keeping it in a vertical position, a pull is exerted simultaneously on two cables fixed to the cradle, one to its upper portion, the other to its lower portion, one of the cables being that one used for normal tilting of the cradle.

Thus the upper extremity of the cradle can be reached from an opening provided for this purpose in a room or chamber in the casting installation at the height of the upper extremity of the cradle and spaced from and behind the casting axis. The first hauling means can advantageously be mounted in this chamber.

With the aim of better understanding the invention, an embodiment of the invention will now be described purely as a non-limiting example by referring to the attached drawings.

DETAILED DESCRIPTION OF PREFERRED EMBODIMENT

Figure 1:
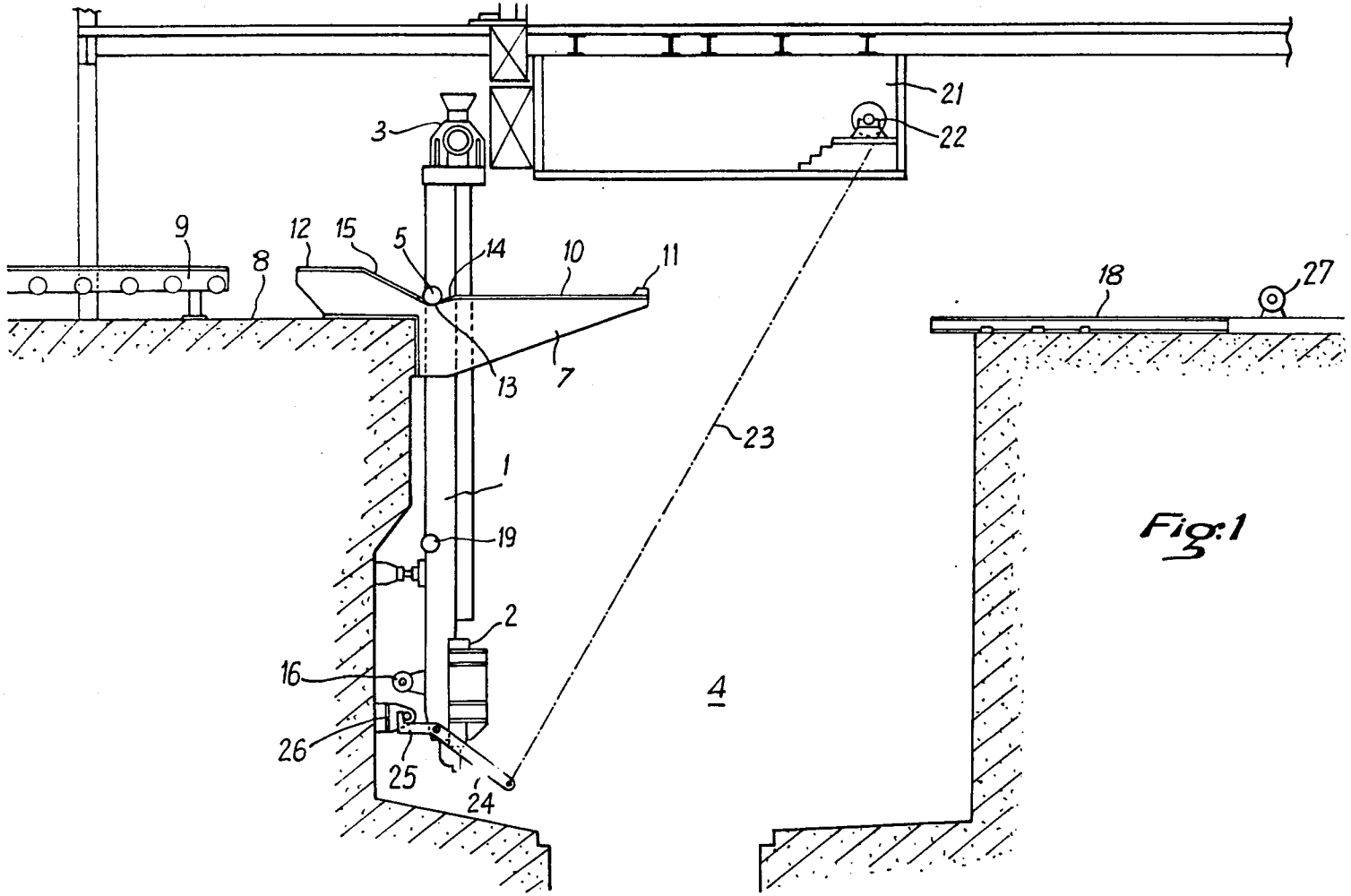
FIG. 1 is a side view in elevation showing schematically the tilting device according to the invention in a vertical position.

The tilting device according to the invention comprises in essence, a cradle 1 and a support or abutment 2 capable of being displaced longitudinally on the cradle beginning from an upper position for receiving the blank formed by vertical continuous casting, to a lower position corresponding essentially to the position shown in FIG. 1, this support being associated with a conventional driving mechanism having an endless chain driven by a motor 3 mounted in the upper part of the cradle.

The cradle of the tilting device is mounted in a trench or well 4 provided in the framework of the casting installation and in which several tilting devices each associated with a casting line can be placed adjacent to each other in side by side relation.

Figure 5:
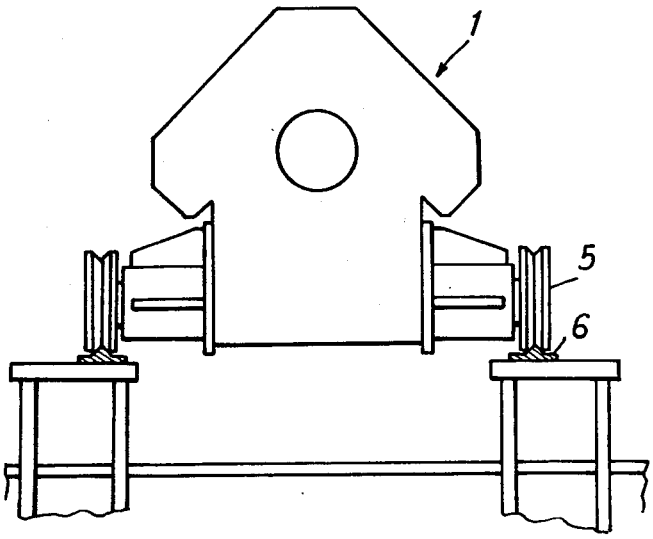
FIG. 5 is a sectional view along line A—A of FIG. 4.

The tilting device comprises rail wheels 5 at its tilting axis enabling the tilting device to roll on rails 6, which can be best seen in FIG. 5, a cantilevered support bracket 7 mounted on and overhanging the edge of floor 8 of the installation and extending toward the front of the installation, in the direction of ejection of the blank onto a rail bed 9 beyond which is a cooling area.

Support 7 comprises a first horizontal surface 10 directed toward the rear of the installation and limited by a stop 11, and a second horizontal surface 12 to the front. Between the two surfaces 10 and 12 is a recess 13 in which the wheels 5 rest in the position of use of the tilting device, the recess 13 being defined by ramps 14 and 15 ending at horizontal surfaces 10 and 12 respectively.

Cradle 1 of the tilting device also has near its lower end, rail wheels 16 mounted below the cradle and enabling the tilting device to roll on rails 17, as can be best seen in FIG. 6, with a platform 18 mounted on the framework of the casting installation behind trench 4.

Figure 9:
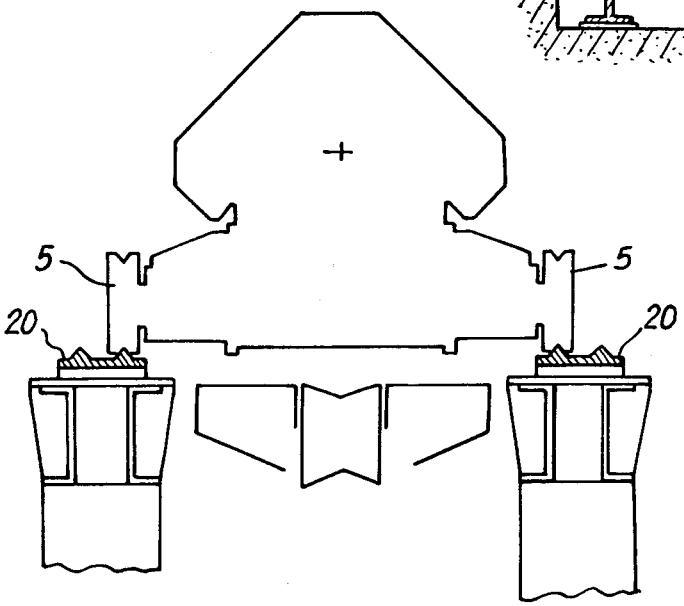
FIG. 9 is a sectional view along line C—C of FIG. 8.
Figure 8:
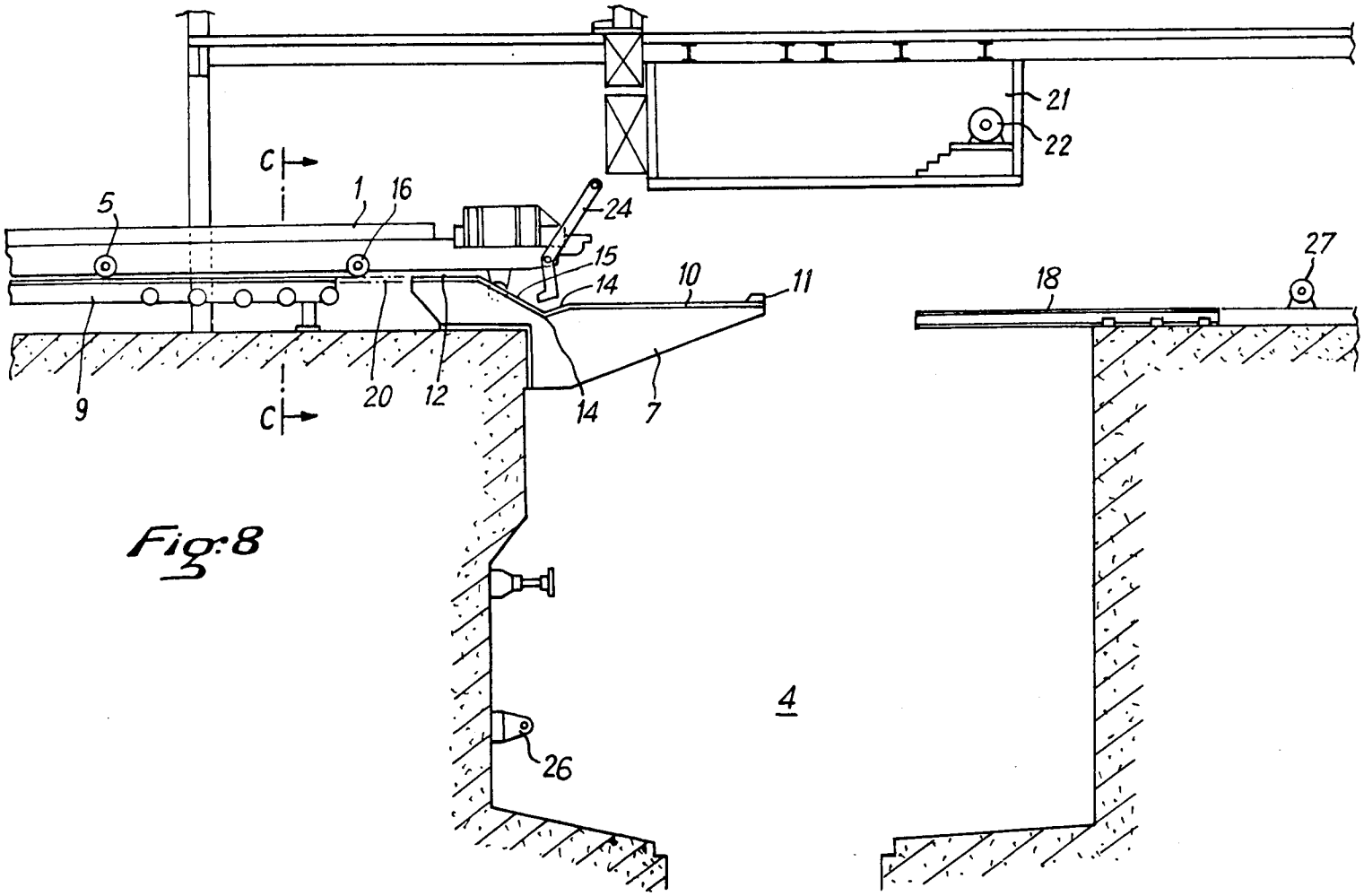
FIG. 8 shows the tilting device of the invention after displacement toward the front while in a horizontal position.

In addition the cradle of the rocker device comprises other wheels 19 aligned with wheels 5 to facilitate rolling the tilting device (in the horizontal position) on rails 20, as can be seen in FIGS. 8 and 9, to the front of the installation, these rails being level with the rails of the horizontal surface 12 of support 7.

In the casting installation, there is a chamber or room 21 disposed essentially at the height of the upper extremity of the tilting device, in a vertical position, and behind it, this chamber containing one or several hauling means, such as a winch 22, whose activation enables the tilting device to tilt as will soon be explained.

The winch 22 is joined by a cable 23 to one end of a lever 24 pivoted on the tilting device 1 and having at its other end a hook 25 capable of being engaged behind a projection 26 fixed to the installation, to retain the rocker in vertical position as shown in FIG. 1.

There is also provided according to the invention, a second hauling means, notably a winch 27 disposed behind platform 18, and one of several other hauling means (not shown) disposed in front of the installation to permit removal and replacement of the tilting device toward the front as will be described in more detail subsequently.

The functioning of the tilting device according to the invention will now be described during different stages of operation.

Figure 2:
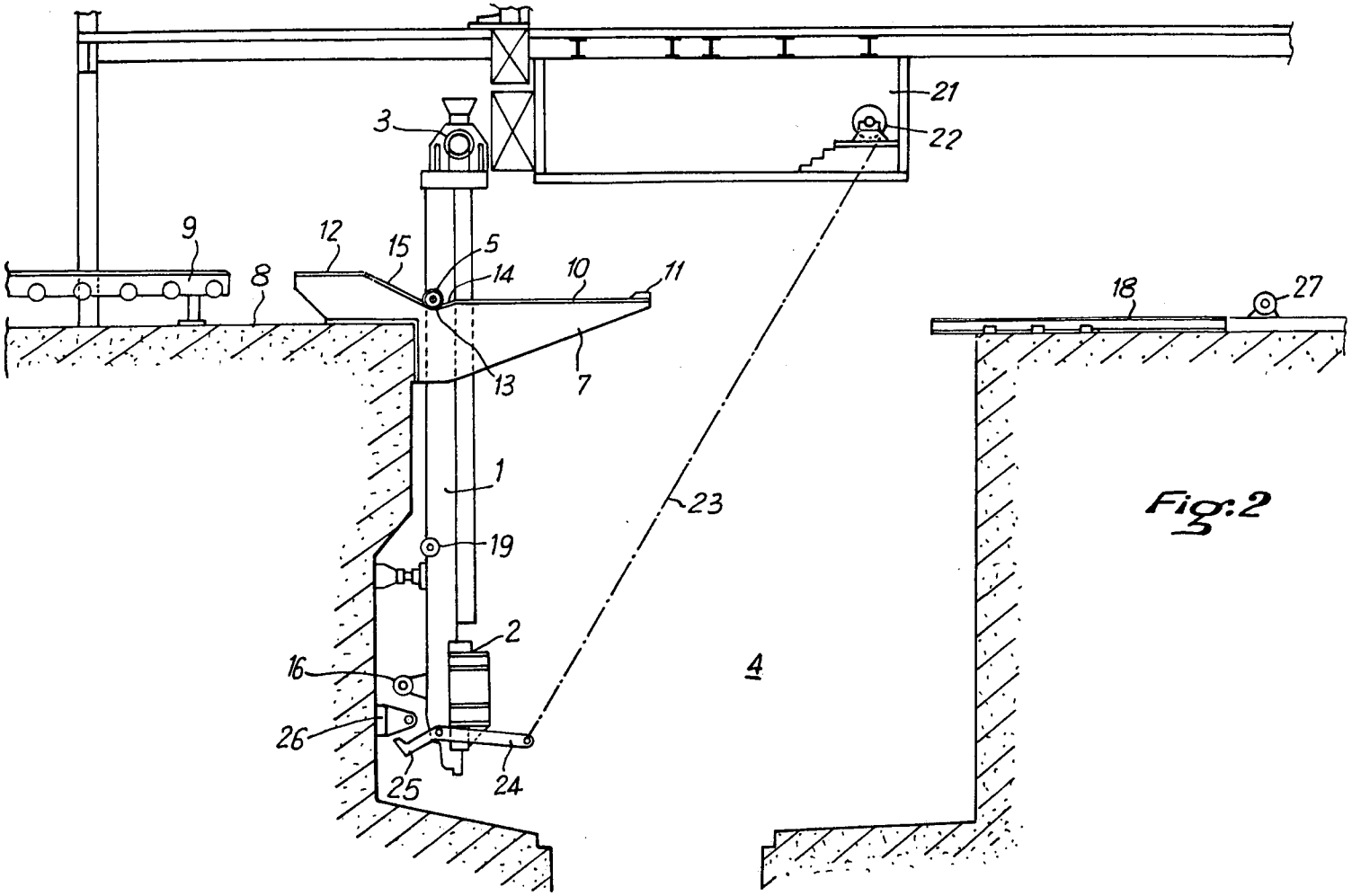
FIG. 2 shows the tilting device of the invention in a vertical position after unlocking of the lower extremity of the cradle.
Figure 3:
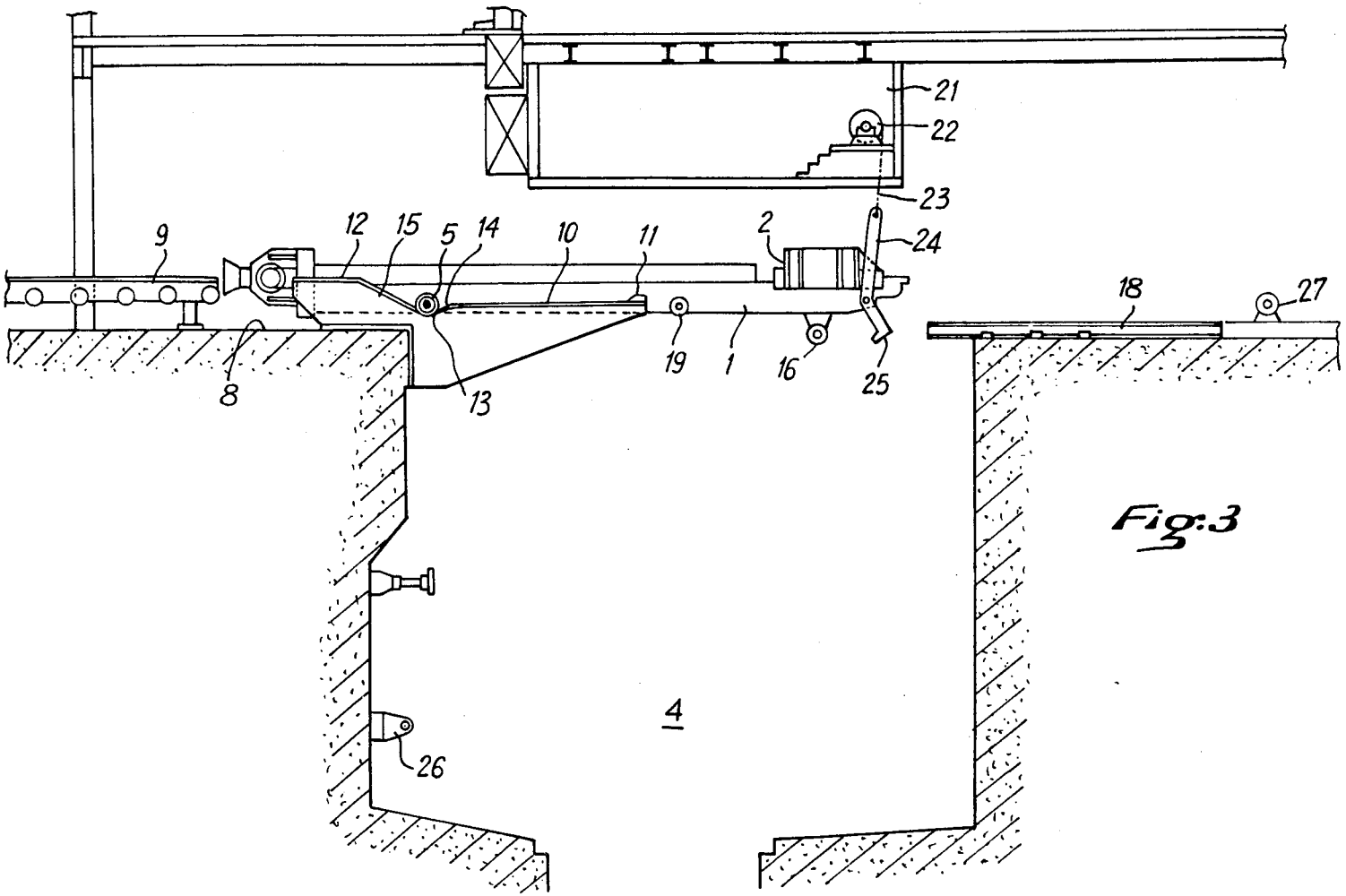
FIG. 3 shows the tilting device of the invention in a horizontal position, after tilting.

The functioning in normal working of the casting installation is shown in FIGS. 1 to 3.

To receive the casting, the rocker device is disposed in the position shown in FIG. 1. When the cut-off section is on the cradle and is ready to be tilted, as shown in FIG. 2, the winch 22 is activated to pull on lever 24 and free hook 25, which unlocks the cradle 1 from the framework of the installation.

One continues to exert a pull on cable 23 by winch 22 until cradle 1 is brought to a horizontal position as shown in FIG. 3. In this position abutment 2 is displaced, from the right toward the left of the drawings, so as to discharge the cut-off section onto the platform or bed 9 in a conventional manner.

After the metal section is ejected, cable 23 is slowly released and cradle 1 returns to the locked vertical position shown in FIG. 1, ready to receive the new casting.

Figure 4:
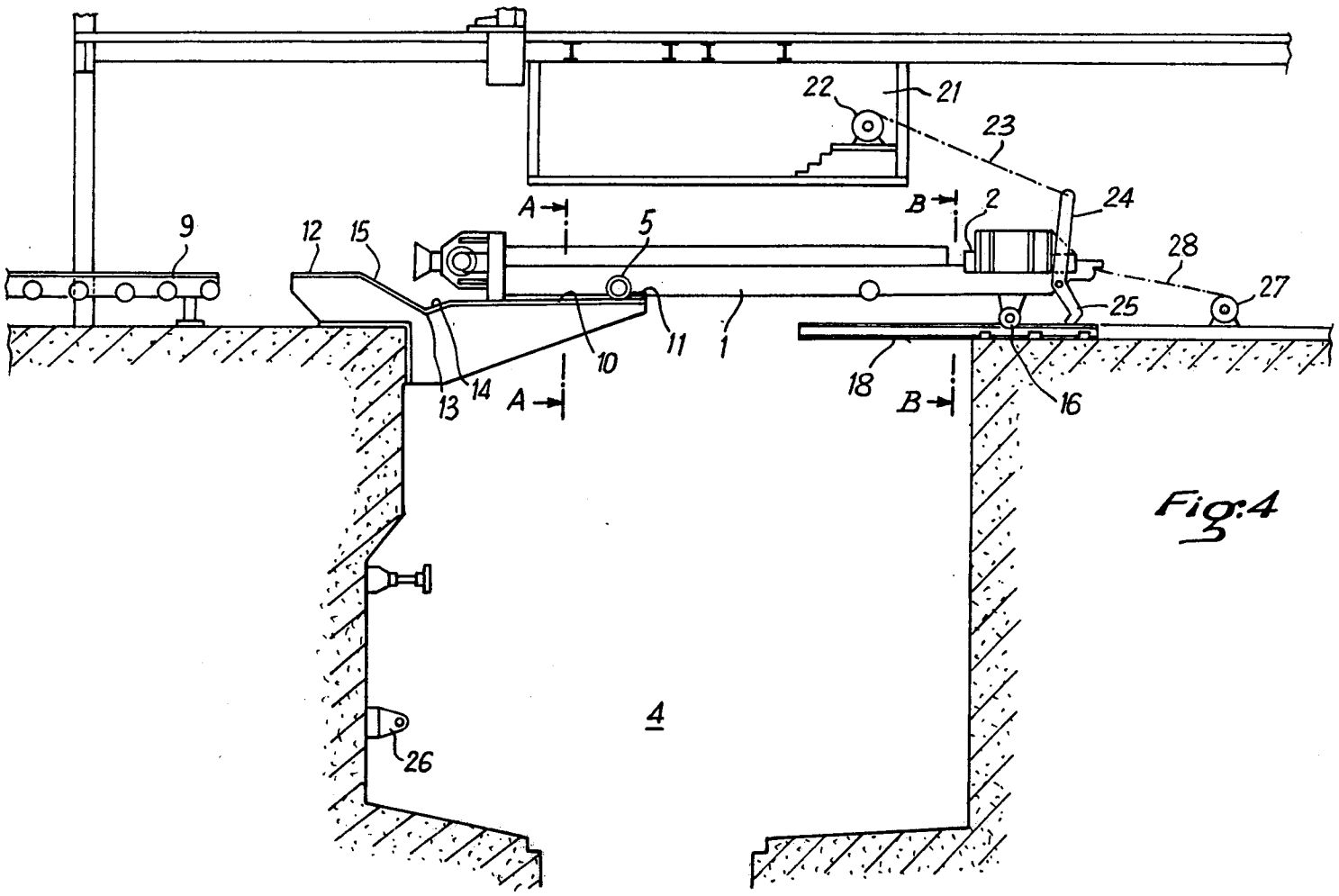
FIG. 4 shows the tilting device of the invention after movement horizontally toward the rear.
Figure 6:
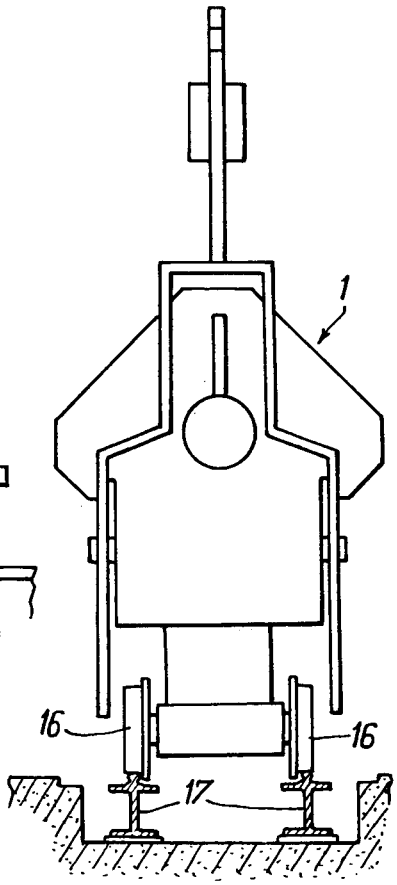
FIG. 6 is a sectional view along line B—B of FIG. 4.

Refer now to FIGS. 4 through 6. When it is desired to carry out a repair or maintenance operation on the lower part of cradle 1 of the tilting device, winch 27 is operated to pull cable 28 fixed for this purpose at the lower extremity of the cradle to move the cradle while in the horizontal position toward the rear, from the position shown in FIG. 3 to the position shown in FIG. 4. By a pull exerted by winch 27, rollers 5 of the cradle disengage themselves from recess 13 and roll on rails 6, on ramp 14 and then on the horizontal surface 10 of support 7 until engaging against stop 11 at the rear extremity of surface 10. During this displacement the guiding of the cradle is facilitated by rollers 16 rolling on rails 17 of a mobile platform 18 provided at the rear of the installation. Platform 18 is extended to the position shown at FIG. 4, where its forward end is beneath the cradle, after the cradle is in the horizontal position of FIG. 3. The platform 18 can be extended by a hydraulic jack or similar mechanism. Examination of FIG. 4 indicates that it is easy for maintenance personnel to reach the lower portion of the cradle when brought over the platform 18 and maintenance operations can be carried out while the adjacent casting lines continue to operate.

After the maintenance or repair operation is completed, the cradle is returned horizontally from its position of FIG. 4 to its position in FIG. 3, after which platform 18 is withdrawn and the cradle is lowered to the vertical position of FIG. 1 to receive the casting.

Figure 7:
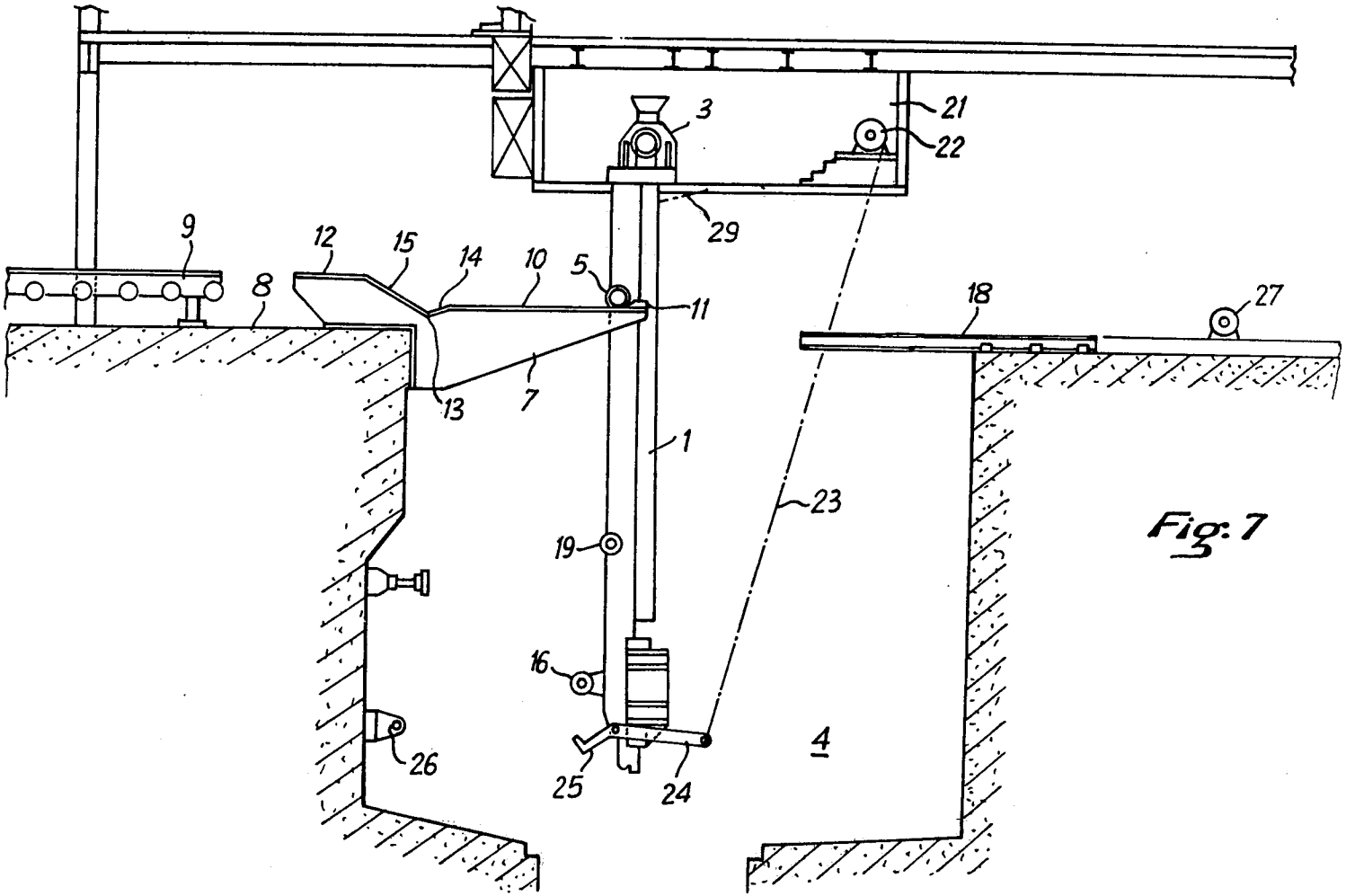
FIG. 7 shows the tilting device of the invention after its displacement toward the rear while in a vertical position.

Refer now to FIG. 7. It can be seen in this figure how cradle 1 is moved while in a vertical position, from its position of FIG. 2, to a position for access to upper extremity of the cradle, which is brought for this purpose into room or chamber 21 through an opening in the front face of this chamber.

When the cradle is in the position shown in FIG. 2, a pull is exerted simultaneously by winch 22 on cable 23, and a pull is exerted (by means not shown) on a cable 29 fixed to the upper part of cradle 1. Cradle 1 under the effect of these two pulls, rolls by wheels 5 on the rails of ramp 14 and surface 10 until engaging against stop 11. Once the repair or maintenance operation terminates, the cradle 1 is brought back, in a vertical position, to its position of FIG. 1 to receive the next casting.

Referring to FIGS. 8 and 9, it can be seen how the complete removal or replacement of the tilting device toward the front of the installation can be carried out. One activates for this purpose hauling means positioned toward the front of the installation, and not shown, in such a way that beginning from its position shown in FIG. 3, cradle 1 rolls in the horizontal position by means of its wheels 5 of rails provided for this purpose on ramp 15, on horizontal surface 12, and then on rails 20, this rolling movement being facilitated by wheels 16.

Although a particular embodiment of the invention has been described, it is very obvious that it is in no way limited to this embodiment and that any desirable modification can be made without going beyond its scope or its intent.

What is claimed is:

1. In a tilting device for metal sections formed by a continuous vertical casting installation along a casting axis between front and rear portions of the installation, a cradle whose length corresponds essentially to the length of the metal section, means mounting said cradle for pivoting around an axis near its center of gravity from a vertical position aligned with the casting axis to a horizontal position, the cradle having a longitudinally movable abutment to support the metal section when the cradle is in the vertical position and to discharge the metal section when the cradle is in the horizontal position, the improvement comprising, means for tilting said cradle from its vertical position to its horizontal position and comprising at least one hauling means, means mounting the hauling means at a location above the pivot axis of the cradle, and offset laterally to the rear of the casting axis, a cable connected between said hauling means and a point on the cradle near a lower extremity of the cradle, and means supporting said cradle for displacement toward and away from the casting axis in both the horizontal position and the vertical position of said cradle.

2. A device according to claim 1 wherein said hauling means comprises a winch.

3. A tilting device according to claim 1 further comprising means for locking the cradle, in its vertical position, to a structure of the casting installation.

4. A tilting device according to claim 3 wherein said locking means comprises, a lever pivoted to the cradle near the lower end of the cradle, said cable being connected to one end of said lever, and said lever having a hook at its other end which engages behind a projection on the structure of the casting installation.

5. A tilting device according to claim 1 further comprising means for displacing the cradle, in its horizontal position, toward the rear and comprising a second hauling means, and means mounting the second hauling means to the rear of the casting axis at approximately the height of the tilting axis of the cradle, and spaced from the tilting axis of the cradle by a distance greater than the distance between the tilting axis and the lower extremity of the cradle.

6. A tilting device according to claim 5 further comprising means to displace the cradle, in its vertical position, and comprising said first mentioned hauling means and cable, and an additional cable secured to the upper part of the cradle, and means for pulling said additional cable.

7. A tilting device according to claim 4 further comprising means to displace the cradle, in its horizontal position, to the front of the casting axis and comprising an additional hauling mechanism spaced to the front of the casting axis.

8. A tilting device according to claim 1 wherein said means mounting said cradle for pivoting around an axis comprises at least two wheels, and means supporting said wheels and comprising a support secured to the structure of the casting installation, said support including two horizontal surfaces each connected to a ramp leading to a recess in which the rollers seat during tilting of said cradle.

9. A tilting device according to claim 8 wherein said horizontal surface extending toward the rear includes stop means for engaging the wheels to limit movement of the tilting device toward the rear.

10. A tilting device according to claim 9 further comprising rails on said horizontal surfaces to the front and to the rear of said casting axis, additional rails beyond said rails on said surface and to the rear of said casting axis, and additional wheels on said cradle for supporting said cradle on said rails and on said additional rails.

* * * * *